US005908138A

United States Patent [19]

Vlahakis et al.

[11] Patent Number: 5,908,138

[45] Date of Patent: Jun. 1, 1999

[54] DISPENSING LID

[75] Inventors: Eftichios Van Vlahakis, 16641 Bolero Ln., Huntington Beach, Calif. 92649; John A. Manolas, Lake Forest, Ill.

[73] Assignee: Eftichios Van Vlahakis, Huntington Beach, Calif.

[21] Appl. No.: 08/993,949

[22] Filed: Dec. 18, 1997

[51] Int. Cl.[6] ..... B65H 1/00

[52] U.S. Cl. ..... 221/63; 206/409

[58] Field of Search ..... 221/63, 33, 34, 221/61, 302; 206/409, 205, 210

[56] References Cited

U.S. PATENT DOCUMENTS 4,607,768 8/1986 Taber et al. ..... 222/556

5,467,893 11/1995 Landis, II et al. ..... 221/34

*Primary Examiner*—Kenneth Noland

*Attorney, Agent, or Firm*—Wallenstein & Wagner, Ltd.

[57] ABSTRACT

An improved dispensing lid for a container is disclosed. The dispensing lid having a generally planar top surface and a side wall depending therefrom and forming a cavity for operatively receiving a mouth of a container. The top surface having a recess and a reservoir of a predetermined depth extending downwardly from the recess and having an opening in the reservoir floor for access to the contents of the container.

12 Claims, 2 Drawing Sheets

DISPENSING LID

TECHNICAL FIELD

The present invention relates to an improved dispensing lid releasably secured to the mouth of a dispenser for disposable towels or towelettes.

BACKGROUND OF THE INVENTION

Many dispensing lids have been developed for the dispensing of contents within containers or canisters. Such dispensing lids may require that consumers reach into an opening in the surface of the lid in order to retrieve a towel or towelette within the container.

This particular method of towel retrieval poses certain problems. Particularly, when the consumer retrieves a subsequent towel, the consumer must repeat the task of extending his fingers through the opening in the surface of the dispensing lid. The task becomes increasingly difficult as the container empties, because the top-most towel is progressively positioned at a lower point within the container.

Furthermore, an opening in the dispensing lid that facilitates such retrieval can lead to evaporation of the moisture on the towels within the container.

The prior art discloses proposed solutions to this problem. Some of the proposed solutions permit a portion of the subsequent towel or towelette to protrude through the opening. For example, Margulies, U.S. Pat. No. 4,462,507 has proposed a opening which has two portions, a slit portion and a larger second portion. The dispensing cap has a lid, also comprised of two parts. The second portion of the lid is flexibly connected to the first portion. As the first portion of the lid is depressed, the second portion pivots away, uncovering the slit. The first portion still covers the larger opening; but, the second, larger portion moves away from the opening to allow the fingers to retrieve subsequent towels.

However, a portion of the towel protrudes through the opening. This impedes the ability to close and seal the container. In other words, if a portion of the towel is allowed to protrude through the opening, the consumer cannot effectively close the opening and, thus, cannot protect the exposed towel or towelette.

Protecting the towel can be of particular importance if the towels must remain sanitary, or if the towels are medicated or otherwise pre-moistened.

Furthermore, it is desirable that the container maintain a closed position when towels are not being dispensed from the container.

One prior dispensing lid addressed some of the problems presented by Magulies. In particular, the prior configuration addressed the problem of providing a way by which a onsumer could easily retrieve pre-moistened towels from a container. The prior dispensing lid included a recess within the top surface forming a reservoir extending downwardly from the recess, whereby the reservoir included an opening in the reservoir floor for access to the contents of the container. The dispensing lid configuration further included a flexible arm member with a closing member formed at the distal end which sealed the reservoir. A portion of the flexible arm formed a loop member protruding away from the body. The prior dispensing lid configuration also included a single projection extending from a flexible arm member and a corresponding aperture on the top surface of the lid to frictionally receive the projection.

While this container enjoyed a reasonable amount of success, it presented yet another problem. When used by a consumer, this dispensing lid failed to adequately seal the container. Particularly, when the loop member was employed for carrying the container, the single protruding member could not withstand the forces applied. Consequently, the lid could not maintain a closed position.

The present invention is provided as an improvement on the prior dispensing lids, to solve these and other problems and to provide other advantages. A preferred embodiment will be disclosed and the novel aspects of the present invention will be identified and discussed.

SUMMARY OF THE INVENTION

One object of the present invention is a dispensing lid for a container that facilitates access to towels, while protecting the towels from excess exposure to air in order to retain the moisture on pre-moistened towels.

It is a further object of the invention to provide a dispensing lid with improved frictional sealing to retain moisture on pre-moistened towels within the container.

It is a still further object of the invention to provide a one-piece dispensing lid with an integral member that permits carrying and transporting of the container.

The above objects are achieved by a dispensing lid for a container which provides both improved closure and improved access to its contents. Preferably, the dispensing lid includes a recess in its top surface, and a reservoir extending downwardly from the recess. The reservoir has an opening in its floor surface by which to access the contents of the container. Furthermore, the reservoir is of a substantial depth. This construction accommodates a portion of the towel, permitting improved access to that towel, while still allowing secure closure of the recess.

Other advantages and aspects of the present invention will become apparent from the following description of the drawings and detailed description of the invention.

BRIEF DESCRIPTION OF THE DRAWINGS

In order that the present invention may be more fully understood, it will now be described by way of example, with reference to the accompanying drawings in which.

DETAILED DESCRIPTION OF THE INVENTION

This invention is susceptible of many different embodiments. The drawings and specification describe in detail one preferred embodiment of the invention. It should be understood that the present disclosure is to be considered as an exemplification of the principles of the invention. The disclosure is not intended to limit the broad aspect of the invention to the illustrated embodiment.

FIGS. 1–5 disclose a one-piece dispensing lid 1 constructed in accordance with the principles of the present invention. Specifically, the dispensing lid 1 facilitates easy access to towels 3 within a canister or container 2, while protecting the towels 3 from excess exposure to air. This protection against exposure arises from improved frictional sealing. The dispensing lid 1 also provides a member for carrying and transporting the container 2, when the dispensing lid 1 is attached to the container 2.

Figure 2:
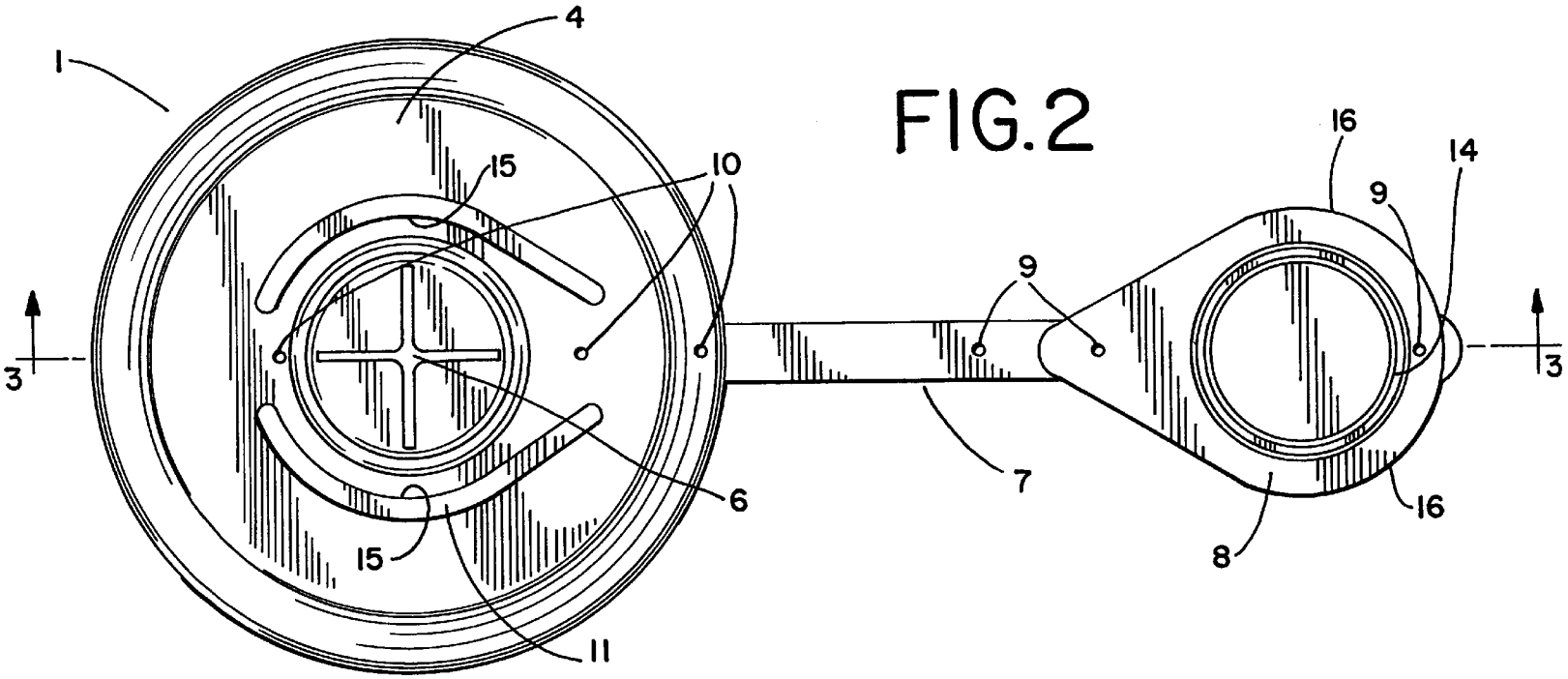
FIG. 2 is a top planar view of the dispensing lid according to the present invention.
Figure 3:
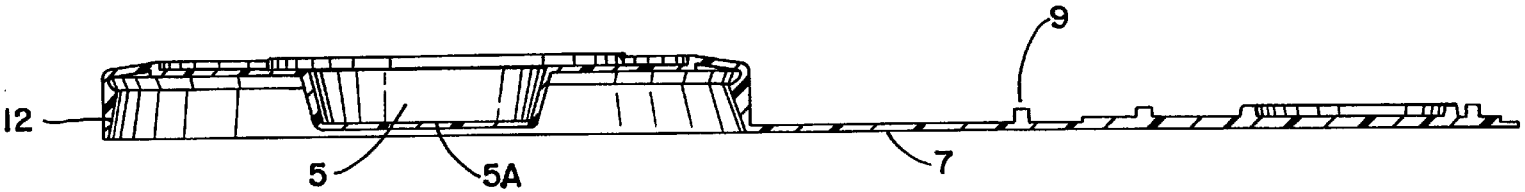
FIG. 3 is a side cross-sectional view of the dispensing lid of FIG. 2, taken along lines 3—3 of FIG. 2.

As may best be seen in FIGS. 2 and 3, the dispensing lid 1 includes a generally planar top surface 4 with a recess, a reservoir 5, a reservoir floor 5*a*, and an opening 6 in the reservoir floor 5*a*. An integral flexible arm member 7 secures a lid closing member 8 to the main body of the dispensing lid 1. The dispensing lid 1 also includes a plurality of tab-like projections 9. A plurality of apertures 10, which receive those projections 9, and a plurality of raised portions 11.

As may be seen in FIG. 3, the top surface 4 has a depending side wall 12, which side wall 12 forms a cavity for receiving a mouth of a container 2. The reservoir 5 extends downward from a recess or opening within the top surface 4, and this reservoir 5 terminates at a floor 5*a* at its base.

As indicated above, the flexible arm member 7 extends from the side wall 12 of the dispensing lid 1. The flexible arm member 7 has the lid closing member 8 at its distal end. The tab-like projections 9 extend outwardly from various predetermined positions on the flexible arm member 7 and the lid closing member 8. The top surface 4 includes a plurality of apertures 10 whose position on the top surface 4 permits locking engagement between the tab-like projections 9 and corresponding apertures 10.

Figure 1:
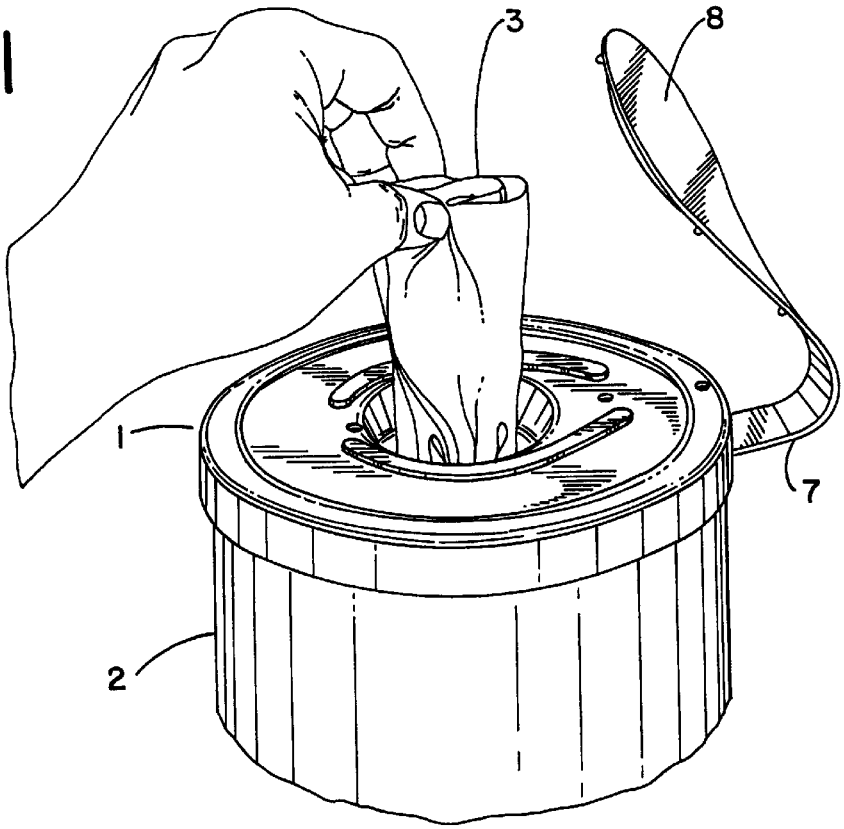
FIG. 1 is a perspective view of the dispensing lid and canister assembly, illustrating the use of the dispensing lid according to the present invention.

The dispensing lid 1 assumes either an open position or a closed position. The open position is depicted in FIG. 1, where the lid closing member 8 is moved away from the reservoir 5. In this open position, a towel 3 extends above the opening 6 in the reservoir floor 5*a*.

Figure 4:
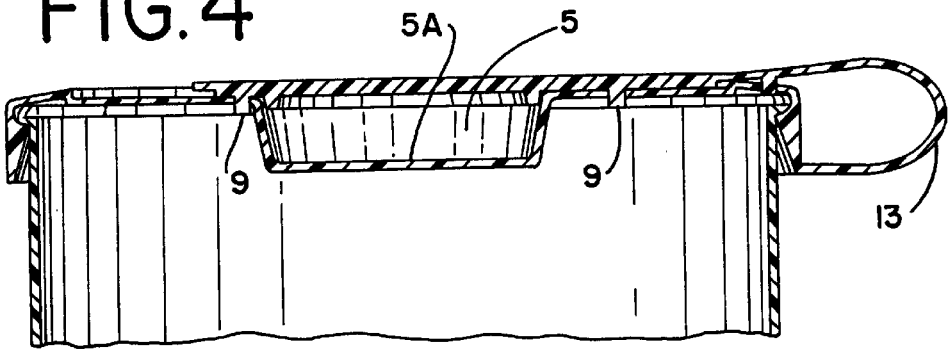
FIG. 4 is a side cross-sectional view of the dispensing lid and canister assembly of FIG. 1.
Figure 5:
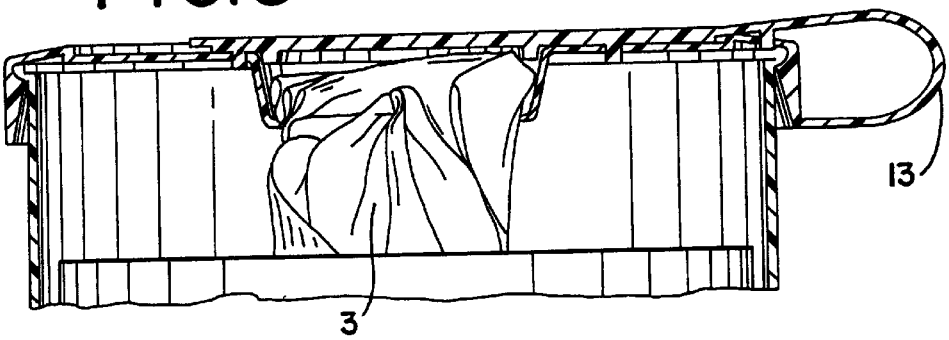
FIG. 5 is a side cross-sectional view of the dispensing lid and canister assembly of FIG. 1 with a towel projecting through the floor surface of the reservoir.

In its closed position, as may be seen in FIG. 5, the flexible arm member 7 is bent so that the lid closing member 8 covers the reservoir 5. When the flexible arm member 7 is bent in the manner shown in FIG. 5, a portion of the flexible arm member 7 protrudes away from the side wall 12 of the dispensing lid 1. This protrusion creates a loop member 13 (FIGS. 4 and 5). The loop 13 may be grasped to permit carrying of the container 2 and dispensing lid 1 assembly. Furthermore, when the dispensing lid 1 is in the closed position of FIGS. 4 and 5, the tab-like projections 9 frictionally engage the corresponding apertures 10 and the inner perimeter 15 of the raised portions 11 frictionally engage the edges 16 of the lid closing member 8.

In the preferred embodiment of the invention, the reservoir 5 has a generally cylindrical geometric shape, and is near the center (FIG. 2) of the top surface 4. The dispensing lid 1 is generally of sufficient depth so as to allow a towel 3 to continue to protrude through the opening 6 within the reservoir floor 5*a*, even when the dispensing lid 1 is in its closed position.

In the preferred embodiment, at least two of the apertures 10 which receive to the tab-like projections 9 are on opposite sides of the reservoir 5. This arrangement provides a secure connection between closing member 8 and top surface 4. However, it is contemplated that the apertures 10 and corresponding tab-like projections 9 could be in various other configurations.

In the preferred embodiment, the lid closing member 8 has ridge member 14 conforming to the geometric shape of the upper edge of the reservoir 5 for frictionally engaging the upper portion of the reservoir 5 when the dispensing lid 1 is in closed position. As noted above, the preferred embodiment also includes two raised portions 11 partially surrounding the reservoir 5 for frictionally receiving the edges 16 of the lid closing member 8. However, it is contemplated that any number of raised portions 11 could be employed such that the raised portions 11 could frictionally accommodate the edges 16 of the lid closing member 8.

The invention has been described with reference to some preferred embodiments of the invention. It will be understood by those skilled in the art that various modifications may be made and equivalents may be substituted without departing from the broader aspects of the invention.

We claim:

1. A dispensing lid comprising:

a generally cylindrical body including a top surface and a side wall depending therefrom and forming a cavity for receiving a mouth of a container;

a recess within the top surface;

a reservoir extending downwardly from the recess, said reservoir having a reservoir floor surface and a reservoir wall;

an opening at the floor surface of said reservoir for access to the contents of the container;

a flexible arm member extending from the side wall including a lid closing member having a peripheral edge, the lid closing member being formed at the distal end of the flexible arm member for engaging the reservoir and securing the lid closing member therewith, the flexible arm further being of a predetermined length such that when the lid closing member engages the reservoir, a portion of the flexible arm forms a loop member protruding away from the body;

a plurality of tab-like projections appending at predetermined positions from the flexible arm member and from the lid closing member; and, a plurality of apertures on the top surface of the body in positional agreement with the tab-like projections for frictionally receiving the tab-like projections.

2. The dispensing lid of claim 1 wherein, the dispensing lid is a one-piece unit.

3. The dispensing lid of claim 1 wherein, the reservoir is generally centrally located in the top surface.

4. The dispensing lid of claim 1 wherein, the opening in the reservoir floor is a slit opening.

5. The dispensing lid of claim 1 wherein, the lid closing member includes a protruding ridge member conforming to the shape of the upper portion of the reservoir for frictionally engaging the reservoir.

6. The dispensing lid of claim 1 wherein, at least two of the apertures are on opposed sides of the reservoir.

7. The dispensing lid of claim 1 wherein the flexible arm is of a predetermined length such that when the lid closing member engages the reservoir, a portion of the flexible arm forms a loop member protruding away from the body.

8. The dispensing lid of claim 1 wherein the lid closing member includes a peripheral edge.

9. The dispensing lid of claim 8 further including a plurality of raised portions on the top surface partially surrounding the reservoir and generally conforming with the peripheral edge of the lid closing member for frictionally receiving the lid closing member.

10. A dispensing lid having a top surface and a side wall depending therefrom and forming a cavity for receiving a mouth of a container, and further having a reservoir extending downward from the top surface the dispensing lid comprising:

a flexible arm member extending from the side wall including a lid closing member, the lid closing member being formed at the distal end of the flexible arm member for engaging the reservoir and securing the lid closing member therewith;

a plurality of tab-like projections appending at predetermined positions from the flexible arm member and on opposite sides of the lid closing member, each of said tab-like projections lying along a straight line; and, a plurality of apertures on the top surface of the body in positional agreement with the tab-like projections for frictionally receiving the tab-like projections.

11. The dispensing lid of claim 10 wherein the flexible arm member is of a predetermined length such that when the lid closing member engages the reservoir, a portion of the flexible arm forms a loop member protruding away from the body.

12. A one-piece unit dispensing lid comprising:

a generally cylindrical body including a top surface and a side wall depending therefrom and forming a cavity for operatively receiving a mouth of a container;

a reservoir in the top surface having a reservoir floor surface and a reservoir wall, the reservoir being centrally located in the top surface;

a slit opening in the reservoir floor surface for receiving contents of the container;

a flexible arm member extending from the side wall including a lid closing member having a peripheral edge, the lid closing member being formed at the distal end of the flexible arm member for engaging the reservoir and securing the lid closing member therewith, the lid closing member having a protruding ridge member conforming to the upper portion of the of the reservoir for frictionally engaging the reservoir, the flexible arm further being of a predetermined length such that when the lid closing member engages the reservoir, a portion of the flexible arm forms a loop member;

a first tab-like projection, a second first tab-like projection and a third tab-like projection appending from predetermined positions of the flexible arm member and from the lid closing member;

a plurality of apertures on the top surface of the generally cylindrical body in positional agreement with the tab-like projections to frictionally receive the tab-like projection; and, a first raised portion and a second raised portion on the top surface partially surrounding the reservoir and generally conforming with the peripheral edge of the lid closing member for frictionally receiving the lid closing member.

* * * * *

UNITED STATES PATENT AND TRADEMARK OFFICE

CERTIFICATE OF CORRECTION

PATENT NO. : 5,908,138
DATED : June 1, 1999
INVENTOR(S) : Eftichios Van Vlahakis; John A. Manolas It is certified that errors appear in the above-identified patent and that said Letters Patent is hereby corrected as shown below:

In Column 1, Line 53, replace "onsumer" with "consumer".
In Column 6, Lines 7-8, replace "of the of the reservoir" with "of the reservoir".
In Column 6, Line 13, replace "a second first tab-like" with "a second tab-like".

Signed and Sealed this

Twenty-fifth Day of April, 2000

*Attest:*

Q. TODD DICKINSON

*Attesting Officer*

*Director of Patents and Trademarks*